US012220052B1

(12) United States Patent
Hargrove

(10) Patent No.: US 12,220,052 B1
(45) Date of Patent: Feb. 11, 2025

(54) STORAGE RACK WITH REMOVABLE AND STOWABLE SHELF

(71) Applicant: Katie Hargrove, Redondo Beach, CA (US)

(72) Inventor: Katie Hargrove, Redondo Beach, CA (US)

( * ) Notice: Subject to any disclaimer, the term of this patent is extended or adjusted under 35 U.S.C. 154(b) by 0 days.

(21) Appl. No.: 18/928,803

(22) Filed: Oct. 28, 2024

(51) Int. Cl.
*A47B 47/00* (2006.01)
*A47B 61/04* (2006.01)

(52) U.S. Cl.
CPC ..... *A47B 47/0075* (2013.01); *A47B 61/04* (2013.01)

(58) Field of Classification Search
CPC ... A47B 47/0075; A47B 61/04; A47B 47/042; A47B 2230/0081; A47B 47/0066; A47B 2230/0037; A47B 45/00; A47B 47/00; A47B 57/06; A47B 57/58; A47B 47/0091; A47B 57/583; A47B 61/00; A47B 61/003; A47B 17/006; A47B 57/30; A47B 2230/0077; A47B 47/04; A47F 7/08
See application file for complete search history.

(56) References Cited

U.S. PATENT DOCUMENTS 2,004,896 A * 6/1935 Knott ..... A47B 83/045 312/297
3,583,780 A * 6/1971 Berkowitz ..... A47B 47/042 312/108
3,713,718 A * 1/1973 Lucci ..... A47B 47/04 217/65
4,021,087 A * 5/1977 Ferguson ..... A47B 17/006 312/263
5,401,095 A * 3/1995 Williams ..... A47B 46/00 312/307
5,454,331 A * 10/1995 Green ..... F16B 12/20 297/440.13
5,507,570 A * 4/1996 Williams ..... A47B 46/00 312/307
7,641,414 B1 * 1/2010 Joyce ..... A47B 88/941 403/231
9,420,879 B1 * 8/2016 Brandenberg ..... A47B 83/045
9,433,284 B2 9/2016 Miranda
2002/0195907 A1 * 12/2002 Lawson ..... A47D 5/00 312/107
2008/0042532 A1 * 2/2008 Crabtree ..... A47B 47/0075 312/257.1

(Continued)

FOREIGN PATENT DOCUMENTS

ES 1071905 4/2010
KR 19990019121 A * 3/1999

(Continued)

*Primary Examiner* — Hiwot E Tefera
(74) *Attorney, Agent, or Firm* — Concourse Law Group; Katherine B. Sales, Esq.

(57) ABSTRACT

A storage rack having a top panel, a first side panel, a second side panel, a rear panel, and at least one removable and stowable interior shelf. Each side panel has at least one rear channel and at least one horizontal channel that is perpendicular to its corresponding rear channel. The rear channels and horizonal channels are aligned with each other. The at least one removable and stowable interior shelf is configured to slide into and out of the aligned horizontal channels and rear channels in the first and second side panels.

10 Claims, 7 Drawing Sheets

(56) References Cited

U.S. PATENT DOCUMENTS

| | | | | |
|---|---|---|---|---|
| 2008/0302279 | A1* | 12/2008 | Clifton | A47B 47/042<br>108/180 |
| 2010/0173122 | A1* | 7/2010 | Susnjara | F16B 12/125<br>144/347 |
| 2018/0092460 | A1* | 4/2018 | Stack | F16B 12/20 |
| 2024/0251941 | A1* | 8/2024 | Boo | A47B 47/042 |

FOREIGN PATENT DOCUMENTS

| | | | | |
|---|---|---|---|---|
| KR | 200314144 | Y1 | * | 8/2003 |
| KR | 200438187 | Y1 | * | 1/2008 |
| KR | 20220048076 | A | * | 4/2022 |

* cited by examiner

STORAGE RACK WITH REMOVABLE AND STOWABLE SHELF

BACKGROUND

Typically, closets at home do not have enough storage space for purses, shoes, boots, and other footwear. Existing storage racks for shoes have a low storage density, as well as other practical limitations. Simultaneously, (walk-in) closets are typically underused, in terms of storage, in one or more corners. Accordingly, there is a need for improved storage capabilities.

SUMMARY

The present invention overcomes several of the deficiencies, disadvantages and undesired parameters associated with the known storage racks. The invention allows the user to adjust the height of the storage compartments depending on what is being stored. Additionally, when the interior shelf is not needed, it can be conveniently stored within the rack so that the user does not have to worry about misplacing, or finding another place to store the shelf when it's not in use.

The invention is directed to a storage rack comprising a top panel, a first side panel, a second side panel, a rear panel, and at least one removable interior shelf.

The top panel has an upper surface and a lower surface, a front edge portion and a rear edge portion, and a first end portion and an opposed second end portion.

The first side panel has an interior surface and an exterior surface, a front edge portion and a rear edge portion, a top edge portion and a bottom edge portion, wherein the top edge portion is coupled to the first end portion of the top panel, at least one rear channel extending along the interior surface of the rear edge portion of the first side panel, and at least one horizontal channel extending along the interior surface of the first side panel.

The second side panel has an interior surface and an exterior surface, a front edge portion and a rear edge portion, a top edge portion and a bottom edge portion, wherein the top end portion is coupled to the second end portion of the top panel, at least one rear channel extending along the interior surface of the rear edge portion of the second side panel, and at least one horizontal channel extending along the interior surface of the second side panel.

The rear panel has an interior surface and an exterior surface, a first side portion and a second side portion, and a top edge portion and a bottom edge portion.

The first side portion is coupled to the rear edge portion of the first side panel, and the second side portion is coupled to the rear edge portion of the second side panel.

The top edge portion is coupled to the rear edge portion of the top panel.

The at least one removable and stowable interior shelf is configured to slide into and out of the aligned horizontal channels and the rear channels in the first and second side panels.

Optionally, the rack has at least two recesses positioned along the upper surface of the first and second end portions configured to receive at least two dowels.

Optionally, the at least one rear channel in the first side panel extends from the top edge portion of the first side panel to the bottom edge portion of the first side panel.

Optionally, the horizontal channel in the first side panel extends from the front edge portion of the first side panel to the rear edge portion of the first side panel, perpendicular to the at least one rear channel along the first side panel.

Optionally, the rear channel in the second side panel extends from the top edge portion of the second side panel to the bottom edge portion of the second side panel.

Optionally, the rear channels in the first and second side panels are aligned with each other.

Optionally, the horizontal channel in the second side panel extends from the front edge portion of the second side panel to the rear edge portion of the second side panel, perpendicular to the at least one rear channel along the second side panel.

Optionally, the horizontal channels in the first and second side panels are aligned with each other.

Optionally, there are two horizontal channels in each of the first and second side panels.

Optionally, the rack comprises two removable interior shelves.

Optionally there are two, parallel rear channels in each of the first and second side panels.

DRAWINGS

These and other features, aspects, and advantages of the present invention will become better understood with regard to the following description, appended claims, and accompanying drawings.

DESCRIPTION

Definitions

Figure 1:
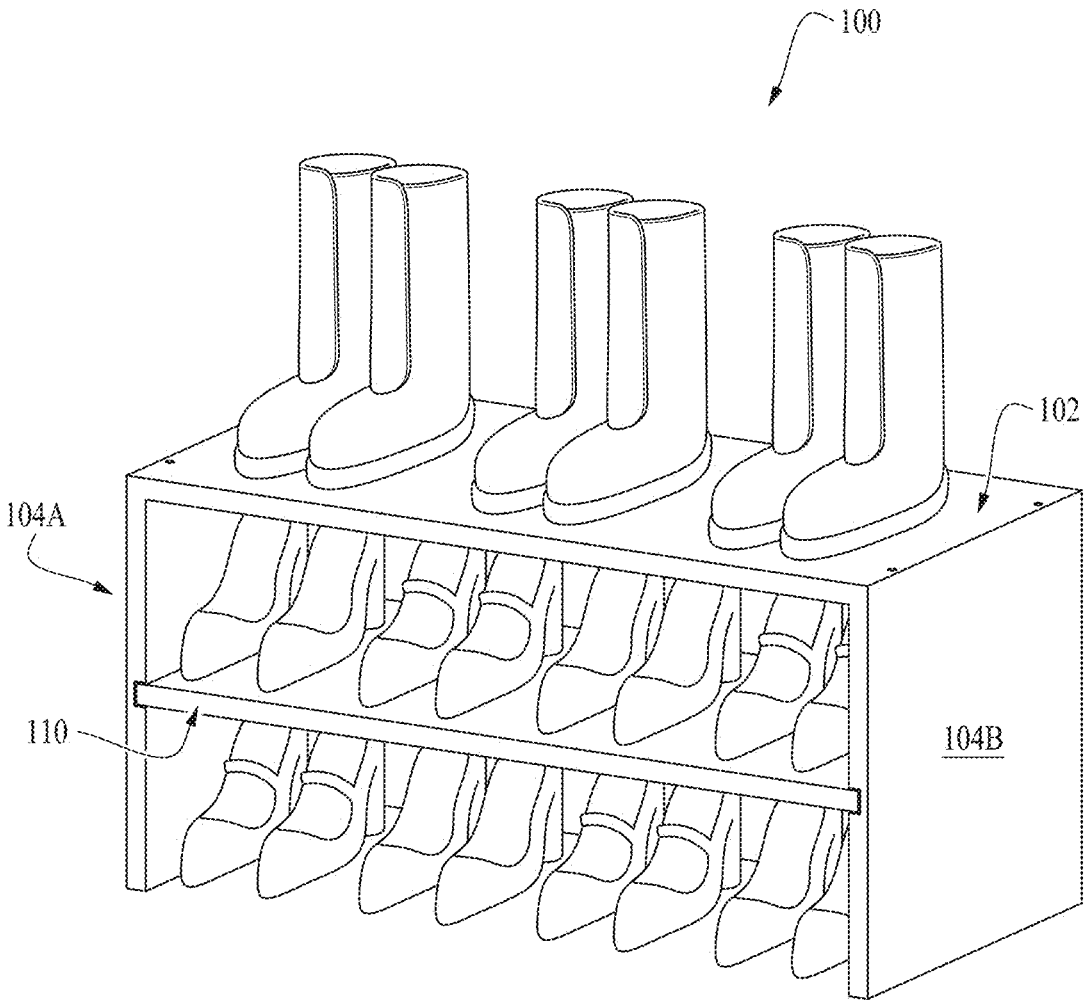
FIG. 1 is a first perspective view of an adjustable storage rack having features of the present invention, wherein various footwear is shown being stored thereon.

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The invention is directed to a storage rack 100 comprising a top panel 102, a first side panel 104A, a second side panel 104B, a rear panel 108 and at least one interior shelf 110.

The top panel 102 has an upper surface 112 and a lower surface 114, a front edge portion 116 and a rear edge portion 118, and a first end portion 120 and an opposed second end portion 122. Optionally, there are at least two recesses 124 positioned along the upper surface 112 of the first and second end portions 120, 122 configured to each receive at least one dowel 126.

The first side panel 104A has an interior surface 128A and an exterior surface 130A, a front edge portion 132A and a rear edge portion 134A, a top edge portion 136A, a bottom edge portion 138A, at least one rear, vertically oriented channel 140A, and at least one horizontal channel 142A.

The top edge portion 136A of the first side panel 104A is coupled to the first end portion 120 of the top panel 102.

The least one rear channel 140A extends along the interior surface 128A of the rear edge portion 134A of the first side panel 104A, from the top edge portion 136A of the first side panel 104A to the bottom edge portion 138A of the first side panel 104A.

The at least one horizontal channel 142A extends along the interior surface 128A of the first side panel 104A, from the front edge portion 132A of the first side panel 104A to the rear edge portion 134A of the first side panel 104A, perpendicular to the at least one rear channel 140A along the first side panel 104A.

The second side panel 104B has an interior surface 128B and an exterior surface 130B, a front edge portion 132B and a rear edge portion 134B, a top edge portion 136B, a bottom edge portion 138B, at least one vertically oriented rear channel 140B, and at least one horizontal channel 142B.

The top edge portion 136B of the second side panel 104B is coupled to the second end portion 122 of the top panel 102.

The at least one rear channel 140B extends along the interior surface 128B of the rear edge portion 134B of the second side panel 104B, from the top edge portion 136B of the second side panel 104B to the bottom edge portion 138B of the second side panel 104B. The rear channels 140A, 140B in the first and second side panels 104A, 104B are aligned along their longitudinal axes with each other.

The at least one horizontal channel 142B extends along the interior surface 128B of the second side panel 104B, from the front edge portion 132B of the second side panel 104B to the rear edge portion 134B of the second side panel 104B, perpendicular to the at least one rear channel 140B of the second side panel 104B. The horizontal channels 142A, 142B in the first and second side panels 104A, 104B are aligned along their longitudinal axes with each other.

The rear panel 108 has an interior surface 144 and an exterior surface 146, a first side portion 148 and a second side portion 150, and a top edge portion 152 and a bottom edge portion 154.

The first side portion 148 of the rear panel 108 is coupled to the rear edge portion 134A of the first side panel 104A, the second side portion 150 of the rear panel 108 is coupled to the rear edge portion 134B of the second side panel 104B, and the top edge portion 152 of the rear panel 108 is coupled to the rear edge portion 118 of the top panel 102. Specifically, the top edge portion 152 of the rear panel 108 is coupled to either an exterior portion of the rear edge portion 118 of the top panel 102, or it is coupled to the lower surface 114 of the rear edge portion 118 of the top panel 102.

The at least one removable and stowable interior shelf 110 is configured to slide into and out of the aligned horizontal channels 142A, 142B and the rear channels 140A, 140B in the first and second side panels 104A, 104B.

Referring now to FIG. 1, there is shown the rack 100 with the interior shelf 110 installed within the horizontal channels 142A, 142B of the first and second side panels 104A, 104B. Additionally, various footwear is shown being stored thereon.

Figure 2:
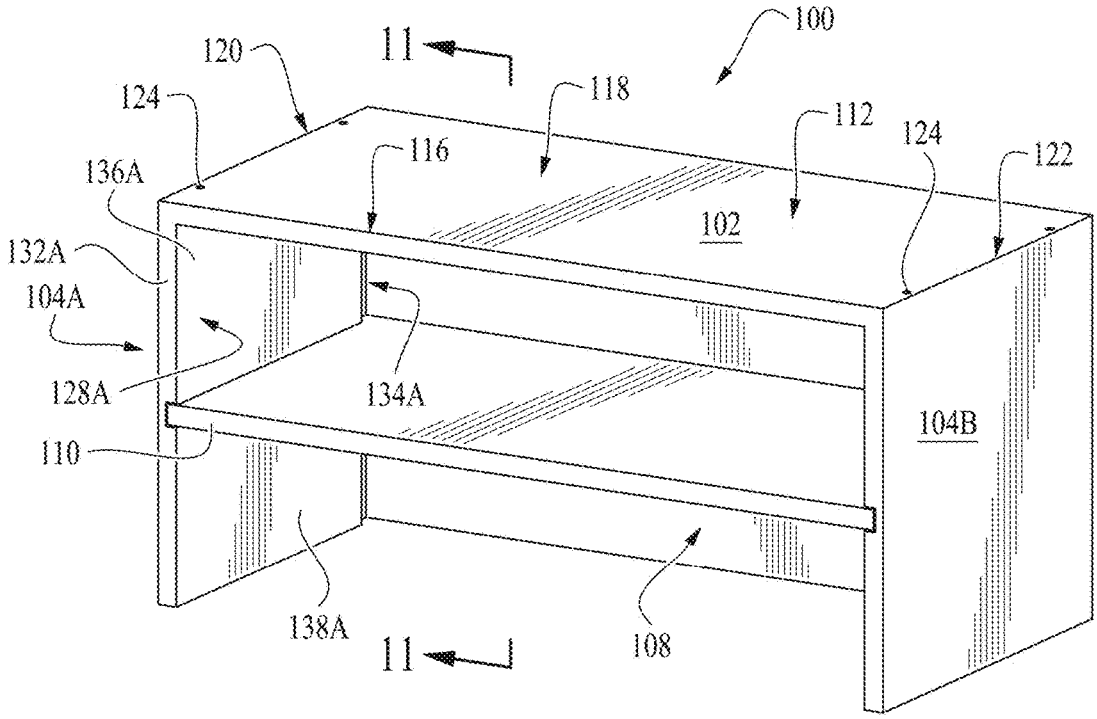
FIG. 2 is a second perspective view of the rack of FIG. 1, wherein no items are being stored thereon.

Referring now to FIG. 2, there is shown the rack 100 from FIG. 1, wherein the footwear has been removed so that the entirety of the rack 100 can be seen.

Figure 3:
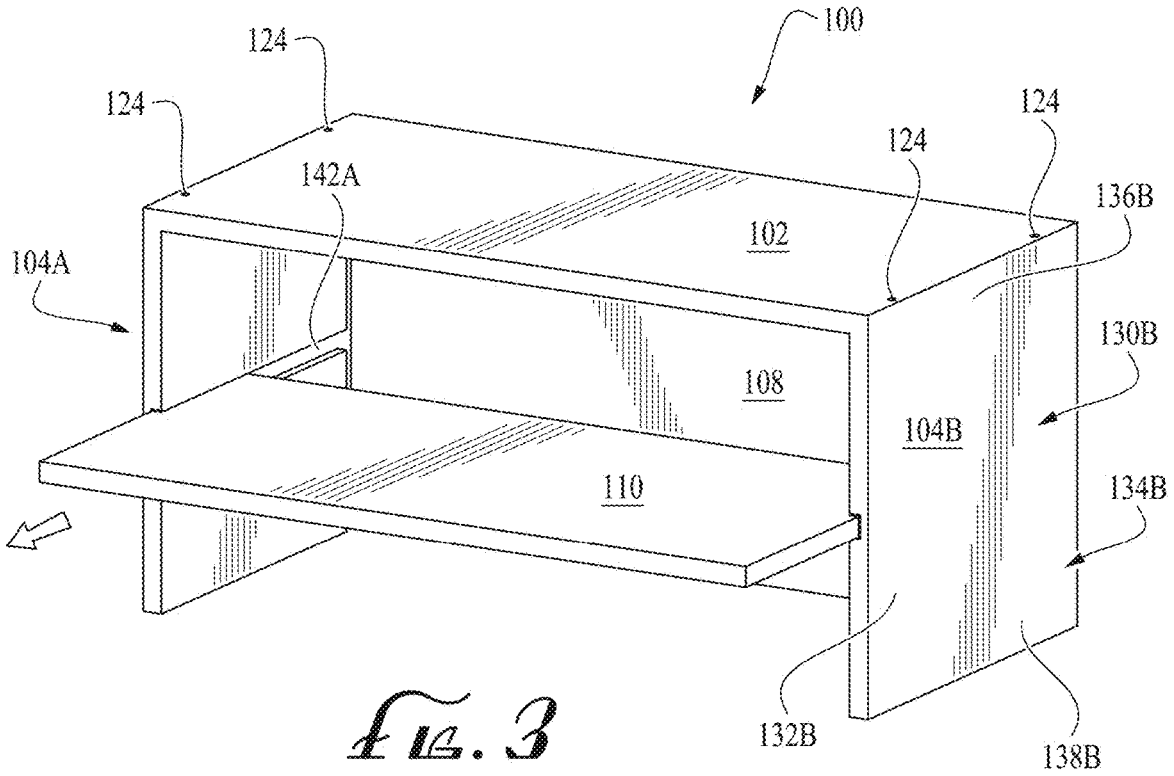
FIG. 3 is a perspective view of the rack of FIG. 2, wherein a first step in removing an interior shelf is shown with the arrow.

Referring now to FIG. 3, there is shown a first step in removing the shelf 110 from the rack 100. The shelf 110 is slid outward from the horizontal channels 142A, 142B.

Figure 4:
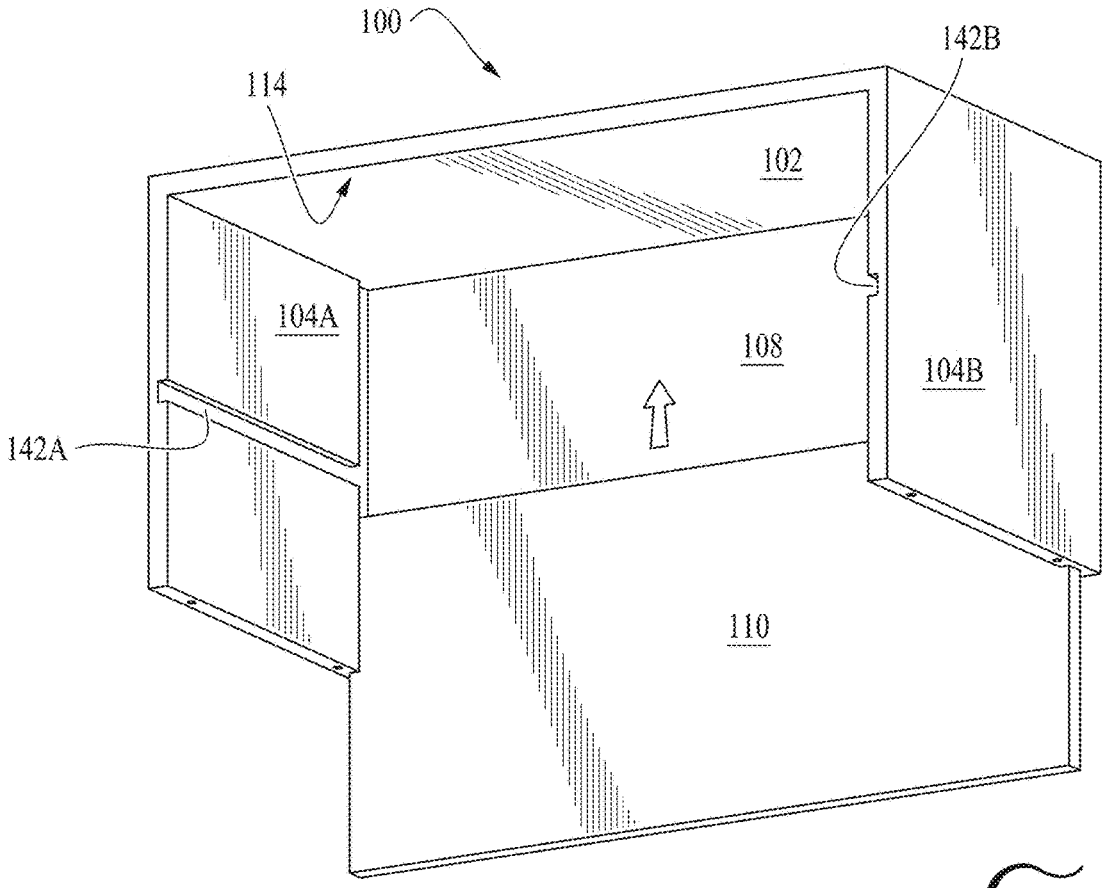
FIG. 4 is a bottom, perspective view of the rack of FIG. 2, wherein a second step of stowing the interior shelf along a rear wall of the rack is shown.
Figure 5:
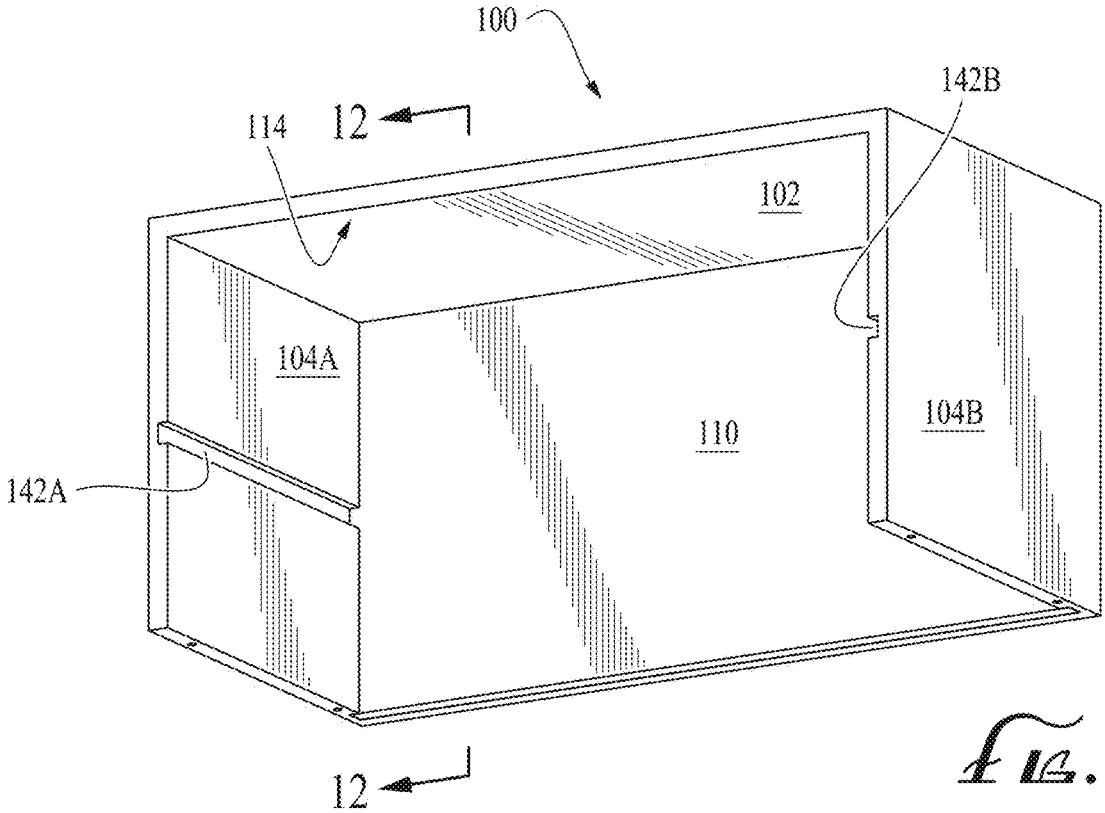
FIG. 5 is an additional bottom, perspective view of the rack of FIG. 4, wherein the interior shelf is completely stowed along the rear wall of the rack.

Referring now to FIGS. 4 and 5, there is shown the stowing of the shelf 110. Once the shelf 110 has been completely removed from the horizontal channels 142A, 142B, the shelf 110 can then be slid into the vertical channels 140A, 140B. Once the shelf 110 is fully inserted into the vertical channels 140A, 140B, as shown in FIG. 5, visually a user cannot tell that the shelf 110 is being stored therein as the rack 100 still maintains is clean, flat rear panel appearance (even though the shelf 110 is now positioned in front of the rear panel 108).

Figure 6:
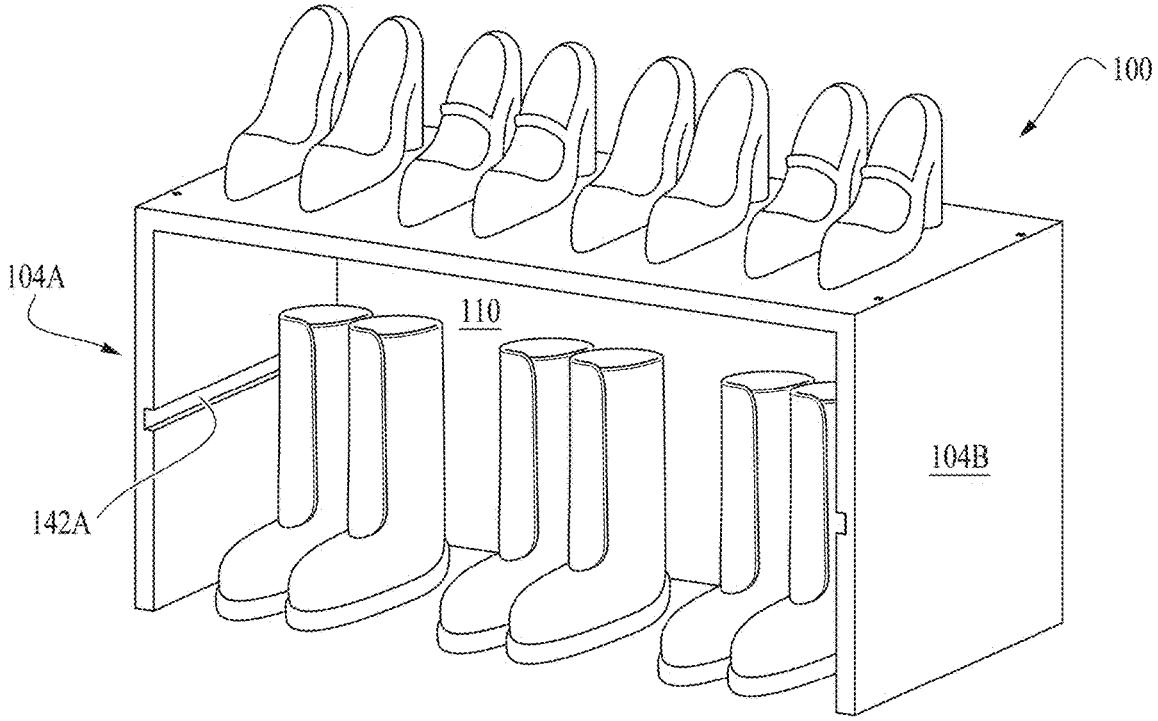
FIG. 6 is a perspective view of the rack of FIG. 5, wherein various footwear items as shown being stored thereon.

Referring now to FIG. 6, there is shown the rack 100 of FIG. 5, where the shelf 110 has been stowed in rear channels 140A, 140B, and the user can then place taller items within the rack 100.

Figure 7:
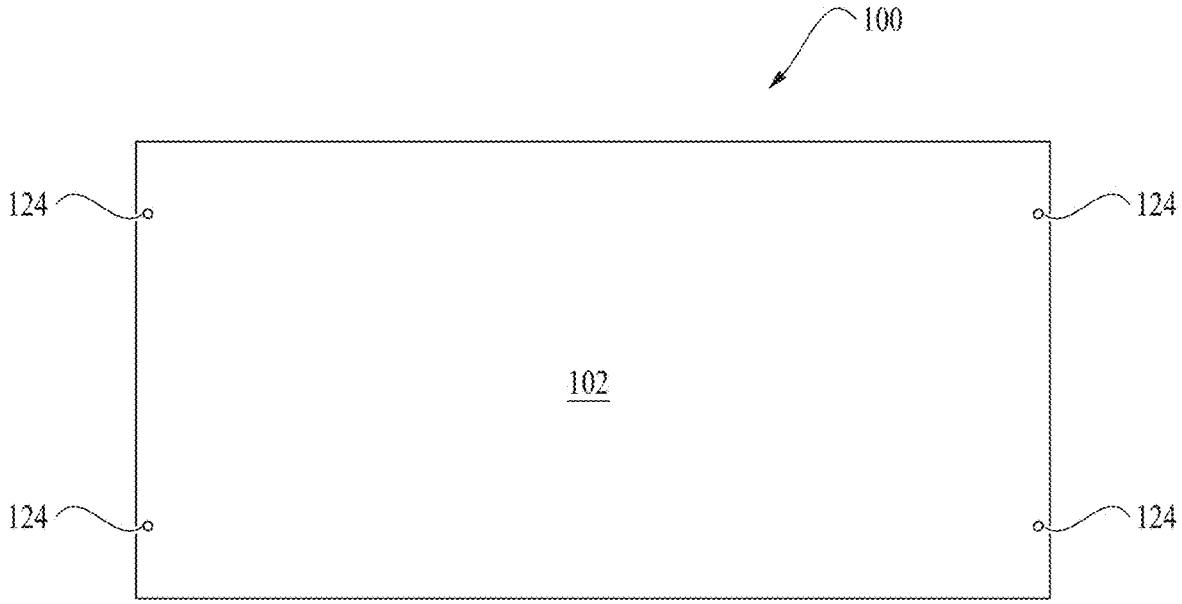
FIG. 7 is a top plan view of the rack of FIG. 5.

Referring now to FIG. 7, there is shown a top plan view of the top of the rack 100. The recesses 124 for the dowels 126 can be seen.

Figure 8:
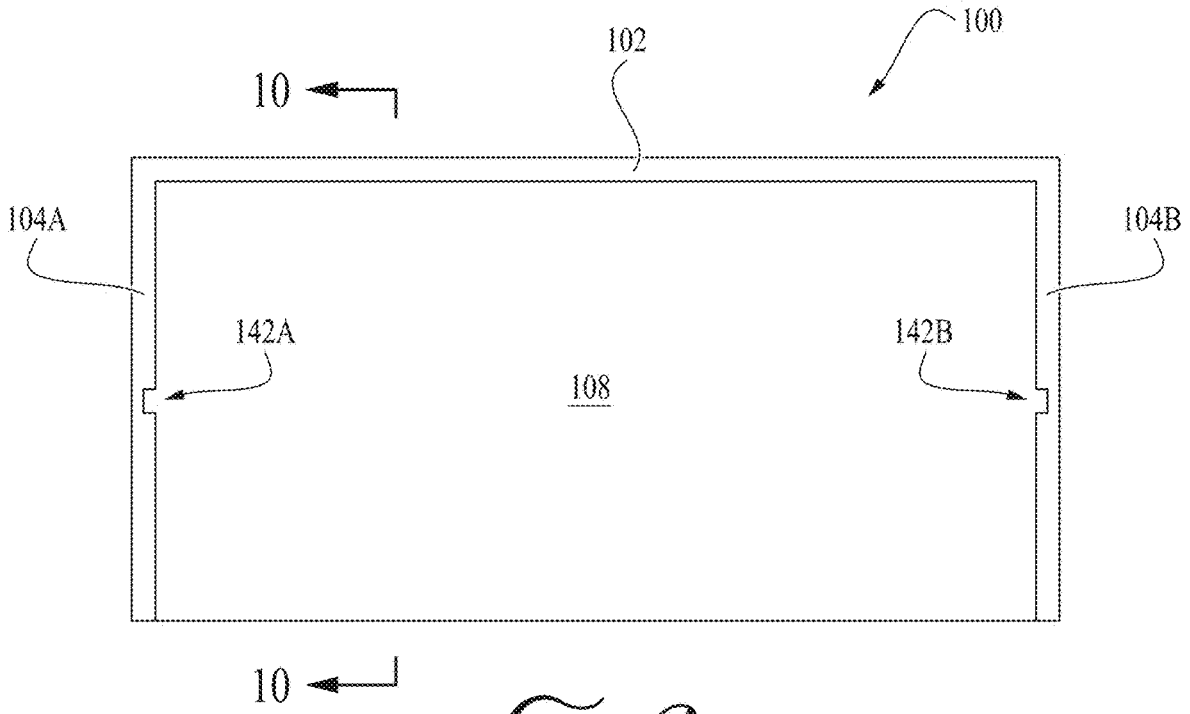
FIG. 8 is a front plan view of the rack of FIG. 5.

Referring now to FIG. 8, there is shown a front plan view of the rack 100, wherein the shelf 110 has been removed from the horizontal channels 142A, 142B, but has not been stowed within the rear channels 140A, 140B.

Figure 9:
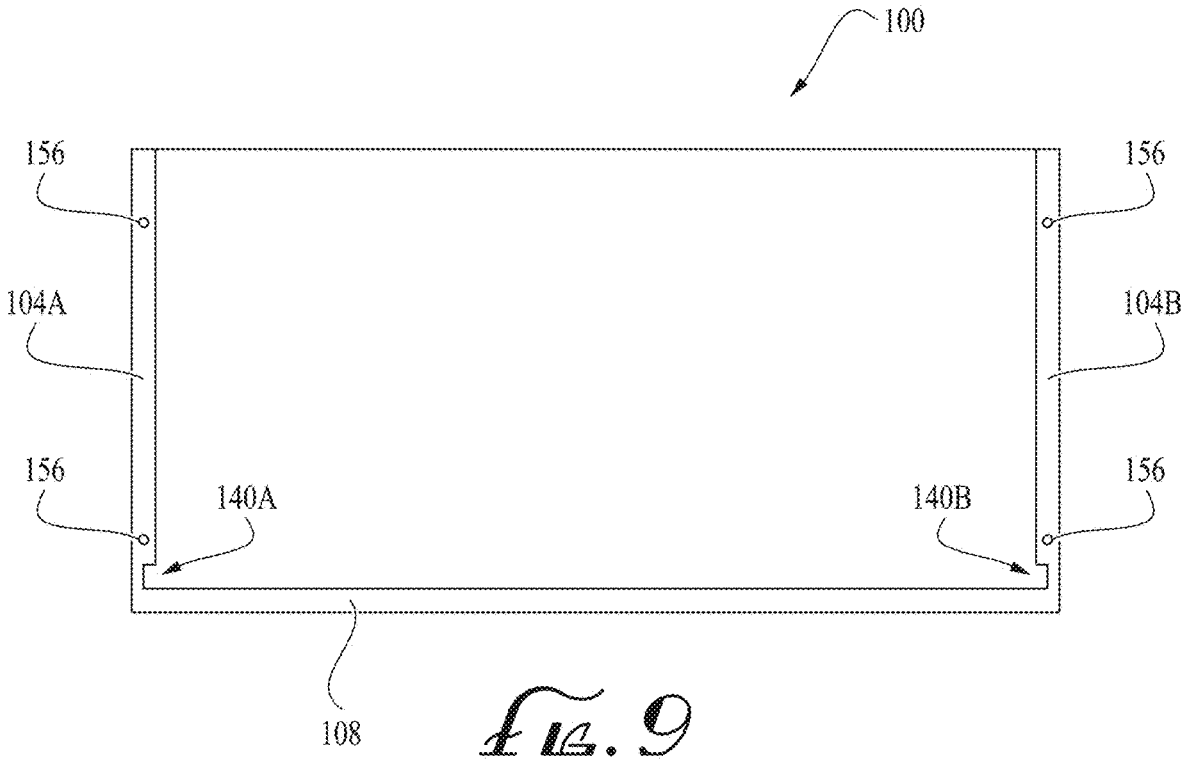
FIG. 9 is a bottom plan view of the rack of FIG. 5.

Referring now to FIG. 9, there is shown a bottom plan view of the rack 100 of FIG. 8, wherein the empty rear channels 140A, 140B can be seen. Additionally, as shown in FIG. 9, the bottom edge portions 138A, 138B can have at least one recess 156 in each to receive a portion of the dowels 126.

Figure 10:
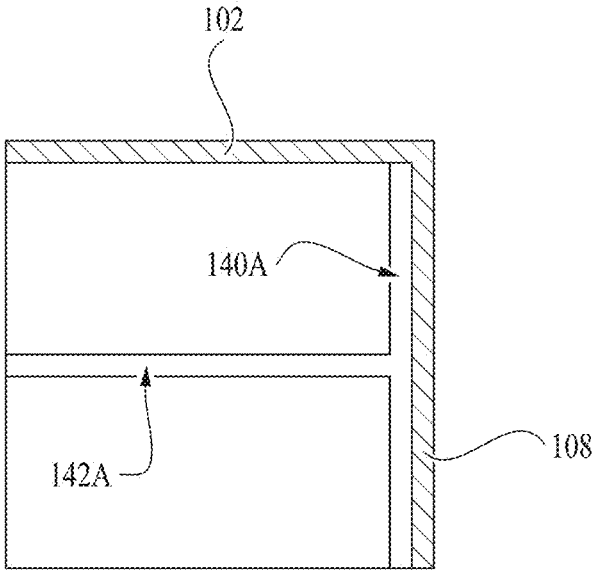
FIG. 10 is a sectional view of the rack of FIG. 8, taken along line 10-10.

Referring now to FIG. 10, there is shown a sectional view of the rack 100 of FIG. 8, wherein the shelf 110 has been removed from the horizontal channels 142A, 142B, but has not been inserted into the rear channels 140A, 140B. Thus, both the horizontal channels 142A, 142B and the rear channels 140A, 140B are empty.

Figure 11:
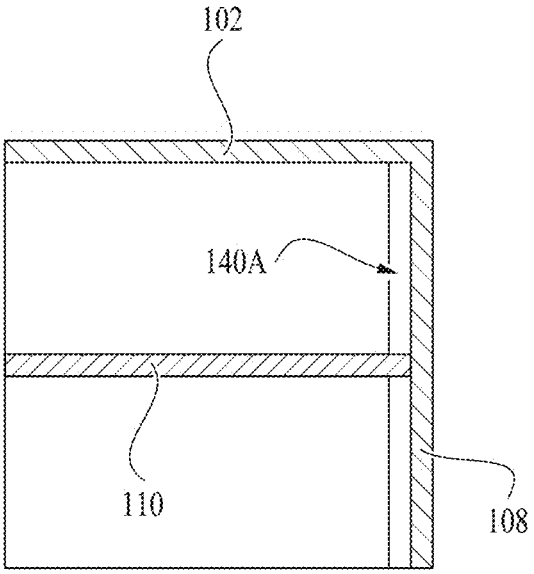
FIG. 11 is a sectional view of the rack of FIG. 2, taken along line 11-11.

Referring now to FIG. 11, there is shown a sectional view of the rack 100 of FIG. 2, wherein the shelf 110 is positioned within the horizontal channels 142A, 142B.

Figure 12:
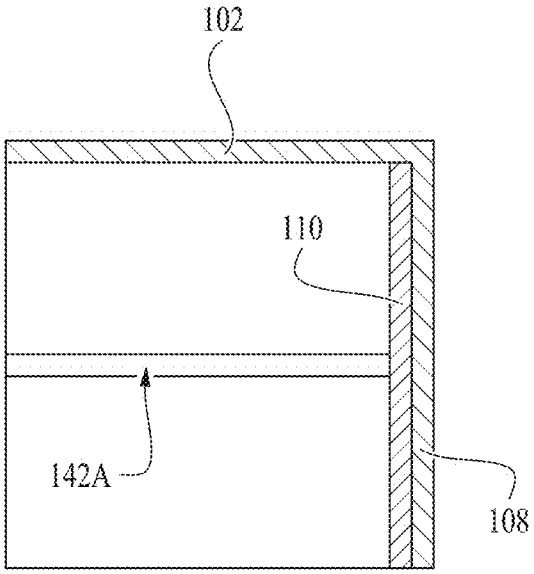
FIG. 12 is a sectional view of the rack of FIG. 5, taken along line 12-12.

Referring now to FIG. 12, there is shown a sectional view of the rack 100 of FIG. 5, wherein the shelf 110 has been removed from the horizontal channels 142A, 142B and has been inserted into the rear channels 140A, 140B for storage.

Figure 13:
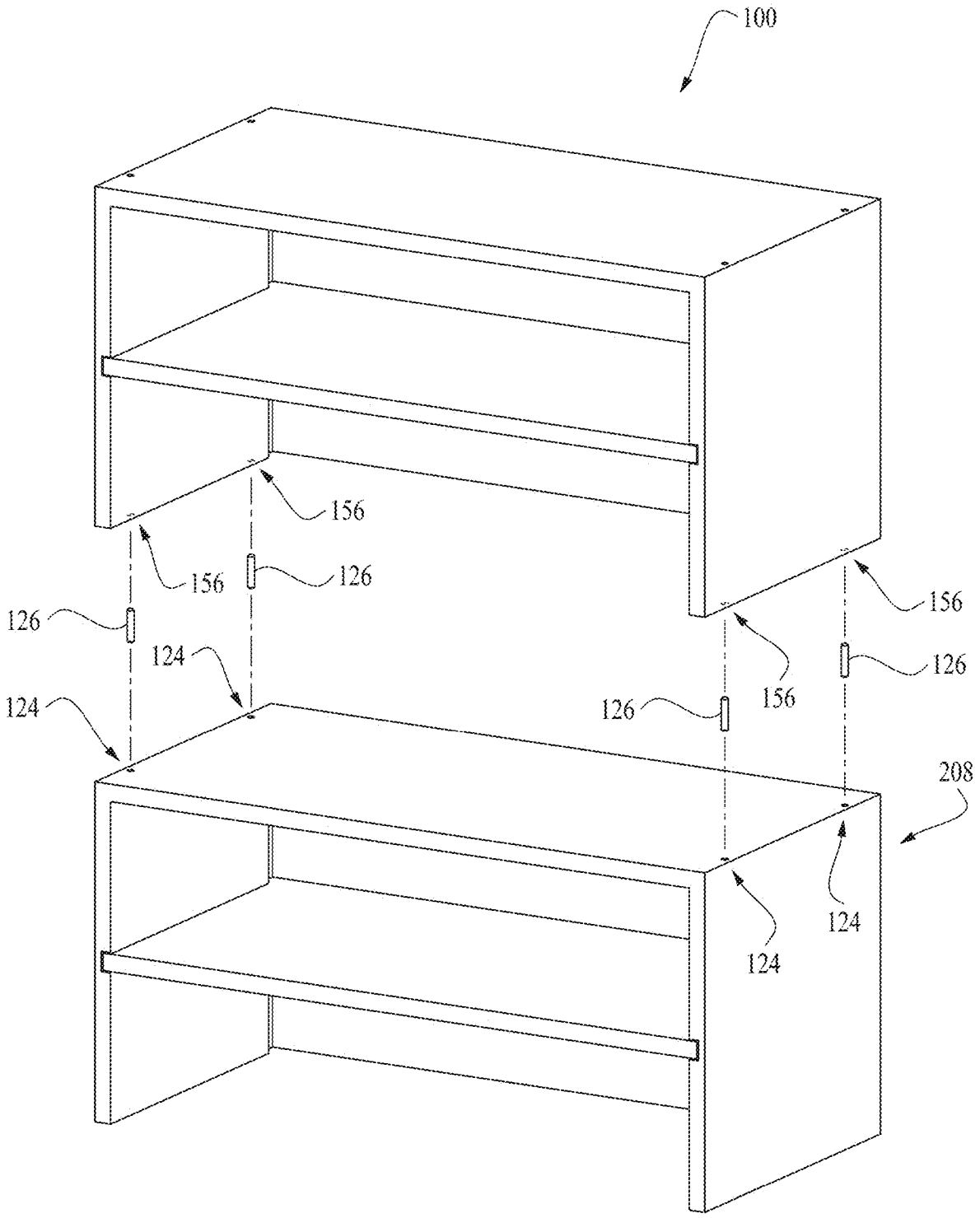
FIG. 13 is a perspective view of the rack of FIG. 2, wherein a second rack is shown being coupled thereto.

Referring now to FIG. 13, there is shown two racks 100, 200, wherein a first rack 100 is being stacked onto a second rack 200, and the dowels 126 and recesses 124, 156 are used to secure the racks 100, 200 to each other. It should be noted that while only two racks 100, 200 are shown here, a plurality of racks 100, 200 can be stacked on top of each other.

Optionally, the rack 100 can have two or more removable and stowable interior shelves 110. In that configuration, each side panel 104A, 104B has two or more aligned horizontal channels 142A, 142B (to hold the two or more shelves 110), and optionally, each side panel 104A, 104B also has two or more rear channels 140A, 140B in which to retain the shelves 110 when they are not in use.

Alternatively, instead of a plurality of rear channels 140A, 140B, the side panels 104A, 104B of the rack 100 can have a single, double-wide set of rear channels 140A, 140B that are wide enough to retain two (or more) shelves 110 within the single set of rear channels 140A, 140B.

The rack 100 can be made from plastic, metal, composite materials, MDF, wood, or any combination of the foregoing materials. Additionally, while individual panels (top, sides, rear) were called out in the specification, it is envisioned that the panels 102, 104, 108 of the rack 100 can be integrally formed with each other such that they are not necessarily individual panels that have been connected to each other.

Additionally, the panels 102, 104, 108 can be removably coupled to each other such that the rack 100 can disassemble and be flat packed, and then reassembled when use is needed.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended features should not be limited to the description of preferred embodiments contained in this disclosure. All references cited herein are incorporated by reference in their entirety.

What is claimed is:

1. A storage rack comprising:

a) a top panel having:

i) an upper surface and a lower surface;

ii) a front edge portion and a rear edge portion; and iii) a first end portion and an opposed second end portion;

wherein there are at least two recesses positioned along the upper surface of the first and second end portions configured to receive at least two dowels;

b) a first side panel having:

i) an interior surface and an exterior surface;

ii) a front edge portion and a rear edge portion;

iii) a top edge portion and a bottom edge portion, wherein the top end portion is coupled to the first end portion of the top panel;

iv) at least one rear channel extending along the interior surface of the rear edge portion of the first side panel, from the top edge portion of the first side panel to the bottom edge portion of the first side panel;

v) at least one horizontal channel extending along the interior surface of the first side panel, from the front edge portion of the first side panel to the rear edge portion of the first side panel, perpendicular to the at least one rear channel along the first side panel;

c) a second side panel having:

i) an interior surface and an exterior surface;

ii) a front edge portion and a rear edge portion;

iii) a top edge portion and a bottom edge portion, wherein the top edge portion is coupled to the second end portion of the top panel;

iv) at least one rear channel extending along the interior surface of the rear edge portion of the second side panel, from the top edge portion of the second side panel to the bottom edge portion of the second side panel, wherein the rear channels in the first and second side panels are in line with each other;

v) at least one horizontal channel extending along the interior surface of the second side panel, from the front edge portion of the second side panel to the rear edge portion of the second side panel, perpendicular to the at least one rear channel along the second side panel, wherein the horizontal channels in the first and second side panels are in line with each other;

d) a rear panel having:

i) an interior surface and an exterior surface;

ii) a first side portion and a second side portion, wherein the first side portion is coupled to the rear edge portion of the first side panel, and the second side portion is coupled to the rear edge portion of the second side panel; and iii) a top edge portion and a bottom edge portion, wherein the top edge portion is coupled to the rear edge portion of the top panel; and e) at least one removable and stowable interior shelf configured to slide into and out of the aligned horizontal channels and the rear channels in the first and second side panels; wherein the at least one removable and stowable interior shelf is configured to slide vertically into the at least one rear channel of the first side panel and the at least one rear channel of the second side panel to be stowed in a vertical position.

2. A storage rack comprising:

a) a top panel having:

i) an upper surface and a lower surface;

ii) a front edge portion and a rear edge portion; and iii) a first end portion and an opposed second end portion;

b) a first side panel having:

i) an interior surface and an exterior surface;

ii) a front edge portion and a rear edge portion;

iii) a top edge portion and a bottom edge portion, wherein the top edge portion is coupled to the first end portion of the top panel;

iv) at least one rear channel extending along the interior surface of the rear edge portion of the first side panel;

v) at least one horizontal channel extending along the interior surface of the first side panel;

c) a second side panel having:

i) an interior surface and an exterior surface;

ii) a front edge portion and a rear edge portion;

iii) a top edge portion and a bottom edge portion, wherein the top end portion is coupled to the second end portion of the top panel;

iv) at least one rear channel extending along the interior surface of the rear edge portion of the second side panel;

v) at least one horizontal channel extending along the interior surface of the second side panel;

d) a rear panel having:

i) an interior surface and an exterior surface;

ii) a first side portion and a second side portion, wherein the first side portion is coupled to the rear edge portion of the first side panel, and the second side portion is coupled to the rear edge portion of the second side panel; and iii) a top edge portion and a bottom edge portion, wherein the top edge portion is coupled to the rear edge portion of the top panel; and e) at least one removable and stowable interior shelf configured to slide into and out of the aligned horizontal channels and the rear channels in the first and second side panels; wherein the at least one rear channel in the first side panel extends from the top edge portion of the first side panel to the bottom edge portion of the first side panel; wherein the horizontal channel in the first side panel extends from the front edge portion of the first side panel to the rear edge portion of the first side panel, perpendicular to the at least one rear channel along the first side panel; wherein the at least one removable and stowable interior shelf is configured to slide vertically into the at least one rear channel of the first side panel and the at least one rear channel of the second side panel to be stowed in a vertical position.

3. The rack of claim 2, further comprising at least two recesses positioned along the upper surface of the first and second end portions configured to receive at least two dowels.

4. The rack of claim 2, wherein the rear channel in the second side panel extends from the top edge portion of the second side panel to the bottom edge portion of the second side panel.

5. The rack of claim 4, wherein the rear channels in the first and second side panels are aligned with each other.

6. The rack of claim 2, wherein the horizontal channel in the second side panel extends from the front edge portion of the second side panel to the rear edge portion of the second side panel, perpendicular to the at least one rear channel along the second side panel.

7. The rack of claim 6, wherein the horizontal channels in the first and second side panels are aligned with each other.

8. The rack of claim 2, wherein there are two horizontal channels in each of the first and second side panels.

9. The rack of claim 8, wherein the rack comprises two removable interior shelves.

10. The rack of claim 8, wherein there are two, parallel rear channels in each of the first and second side panels.

* * * * *